US008201877B2

(12) United States Patent
Hsieh et al.

(10) Patent No.: US 8,201,877 B2
(45) Date of Patent: Jun. 19, 2012

(54) CHAIR WITH ELECTRICALLY ADJUSTABLE COMPONENTS

(75) Inventors: Ping Hsieh, Tainan (TW); Huey-Shiang Julie Lee, Tainan (TW)

(73) Assignees: Ping Hsieh, New Taipei (TW); Huey-Shiang Kuo, Taipei (TW); Chen-Chih Kuo, Taipei (TW)

( * ) Notice: Subject to any disclaimer, the term of this patent is extended or adjusted under 35 U.S.C. 154(b) by 344 days.

(21) Appl. No.: 12/705,625

(22) Filed: Feb. 14, 2010

(65) Prior Publication Data

US 2011/0198894 A1 Aug. 18, 2011

(51) Int. Cl.
*A47C 1/02* (2006.01)

(52) U.S. Cl. ..... 297/89; 297/68; 297/75; 297/85 R; 297/330

(58) Field of Classification Search ..... 297/68, 297/75, 85 R, 89, 330
See application file for complete search history.

(56) References Cited

U.S. PATENT DOCUMENTS 3,016,264 A * 1/1962 Hughes ..... 297/69
4,007,960 A * 2/1977 Gaffney ..... 297/71
4,365,836 A * 12/1982 Jackson et al. ..... 297/85 M
4,621,863 A * 11/1986 Jackson et al. ..... 297/85 M
4,696,512 A * 9/1987 Burnett et al. ..... 297/68
4,852,939 A * 8/1989 Krauska ..... 297/71
4,946,222 A * 8/1990 Matson ..... 297/344.17
5,056,862 A * 10/1991 May et al. ..... 297/85 C
5,076,644 A * 12/1991 Northcutt ..... 297/330
5,219,204 A * 6/1993 Bathrick et al. ..... 297/321
5,312,153 A * 5/1994 Lin ..... 297/89
5,466,046 A * 11/1995 Komorowski et al. ..... 297/325
6,439,636 B1 * 8/2002 Kuo ..... 296/65.09
6,659,556 B2 * 12/2003 Pellerin ..... 297/330
6,722,736 B2 * 4/2004 Guillot ..... 297/330
7,543,885 B2 * 6/2009 Pollard et al. ..... 297/85 R
7,722,114 B2 * 5/2010 Smith ..... 297/68
2009/0174251 A1 * 7/2009 Lawson et al. ..... 297/85 R
2011/0181094 A1 * 7/2011 Lawson et al. ..... 297/85 R

* cited by examiner

*Primary Examiner* — Laurie Cranmer

(57) ABSTRACT

An adjustable chair (1) includes a control unit (2) having an on/off switch (24), an extending operation button (22), and a retracting operation button (23); a reciprocating unit (3) having a limit member (34), a screw-type slide (33) threadedly put on a lead screw (32) and adapted to move between the limit member (34) and a DC motor (31), and a linkage; and two foot, seat, and back adjustment units (4) disposed in the arms (12) respectively, each foot, seat, and back adjustment units (4) having a linkage so that pressing the extending operation button (22) will tilt a seat (14) and a back (13), and extend a foot rest (11).

1 Claim, 12 Drawing Sheets

CHAIR WITH ELECTRICALLY ADJUSTABLE COMPONENTS

BACKGROUND OF THE INVENTION

1. Field of Invention

The invention relates to chairs and more particularly to a chair (e.g., club chair) having electrically adjustable components.

2. Description of Related Art

Chairs with adjustable components are well known in the art. This has the benefits of fitting different individuals with various heights, weights, and job tasks. But adjustment mechanisms employed by this type of conventional chair are most mechanical in nature. That is, a cumbersome manual adjustment is required.

For example, U.S. Pat. No. 5,388,892 discloses a manually operated mechanism for relatively engaging and locking two structural members in a number of positions.

Further, U.S. Pat. No. 4,639,039 discloses a height adjustment mechanism for chair backrest. Thus, it is desirable to provide a novel chair with electrically adjustable components in order to overcome the inadequacies of the prior art.

SUMMARY OF THE INVENTION

It is therefore one object of the invention to provide a chair comprising a seat; two arms; a back; a foot rest; a seat and backrest frame fixedly mounted to the seat and the back; a control unit mounted on either arm and comprising an extending operation button, a retracting operation button, an indicator, an on/off switch, and a printed circuit board (PCB) electrically connected to a direct current (DC) power source, the on/off switch, the indicator, the extending operation button, and the retracting operation buttons; a reciprocating unit mounted under the seat and comprising a base, a DC motor mounted on the base and electrically connected to the DC power source, a lead screw having one end rotatably attached to the DC motor, a limit member mounted on the base and aligned with the DC motor, a screw-type slide threadedly put on the lead screw and adapted to move between the limit member at one end of the lead screw and the DC motor at the other end of the lead screw, two parallel first link members each having one end attached to one side of the screw-type slide, a transverse rod pivotably passing the other ends of the first link members, and two second link members each having one end pivotably connected to either end of the transverse rod; and two foot, seat, and back adjustment units disposed in the arms respectively, each of the foot, seat, and back adjustment units comprising a bent first link having one end pivotably connected to the other end of the second link member, a second link pivotably connected to the other end of the first link, a third link pivotably connected to one end of the second link and the other end connected to the seat and backrest frame, a bent fourth link having a substantial portion parallel to the second link and having one end pivotably connected to one end of the third link, a fifth link pivotably connected to the bent portion of the fourth link and having one end pivotably connected to the other end of the second link, a sixth link parallel to the fifth link and having one end pivotably connected to the other end of the fourth link, and a seventh link pivotably connected to the other end of the sixth link and having one end pivotably connected to the other end of the fifth link, either end of the foot rest being mounted on the seventh link.

The above and other objects, features and advantages of the invention will become apparent from the following detailed description taken with the accompanying drawings.

DETAILED DESCRIPTION OF THE INVENTION

Referring to FIGS. 1 to 11, a mechanism for electrically adjusting components of a chair (e.g., club chair) 1 in accordance with a first preferred embodiment of the invention comprises the following components as discussed in detail below.

A control unit 2 comprises a wire 27, a connector 26 at one end of the wire 27 electrically connected to an adapter A which is electrically connected to a DC (direct current) motor 31. The adapter A is also electrically connected to an outlet (no shown).

Figure 1:
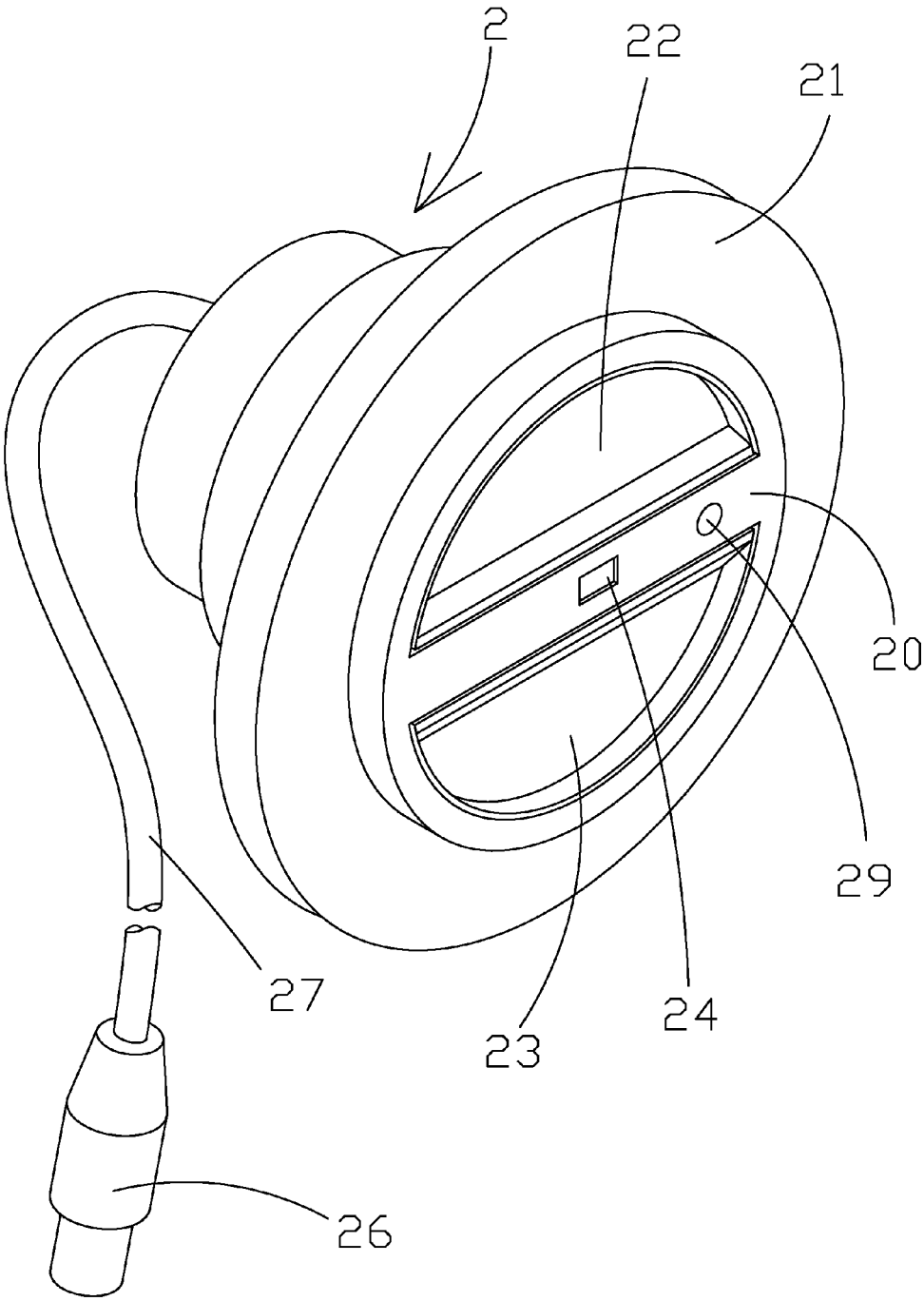
FIG. 1 is a perspective view of a control unit of a mechanism for electrically adjusting components of a chair according to a first preferred embodiment of the invention.
Figure 2:
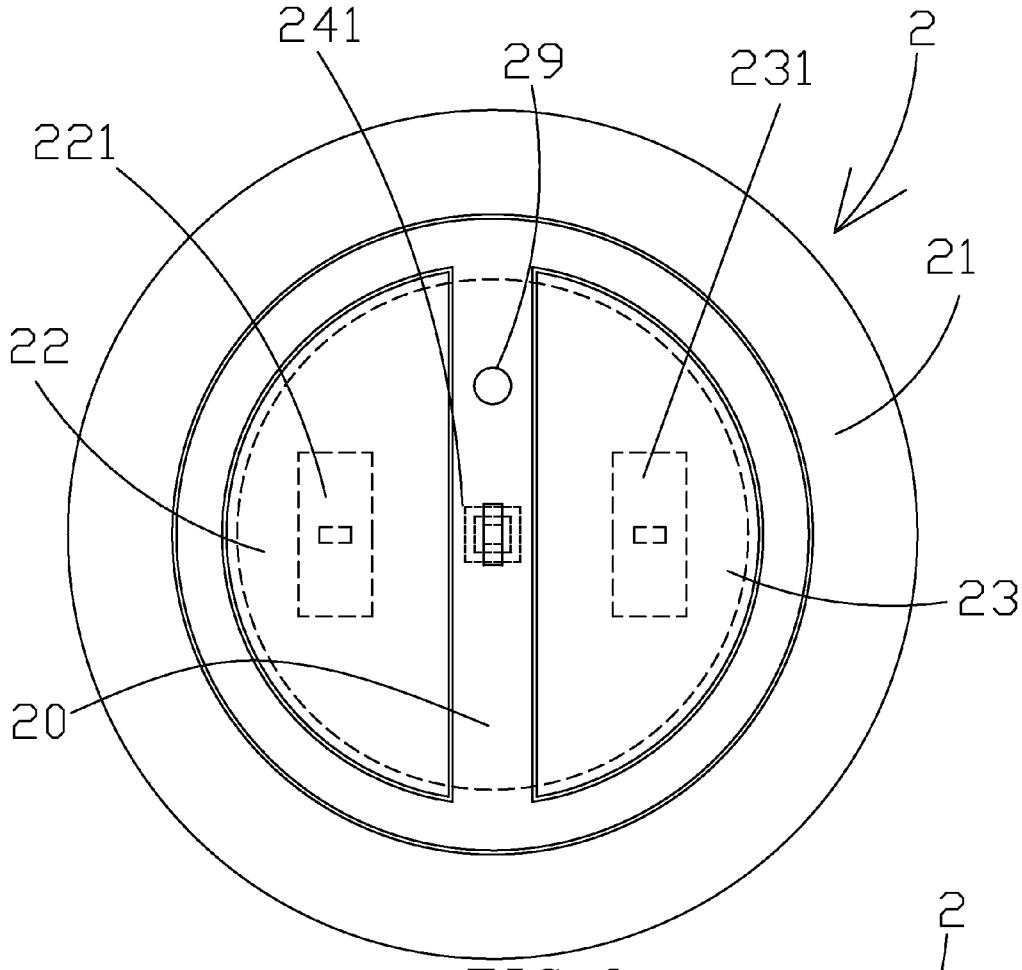
FIG. 2 is a front view of the control unit.
Figure 3:
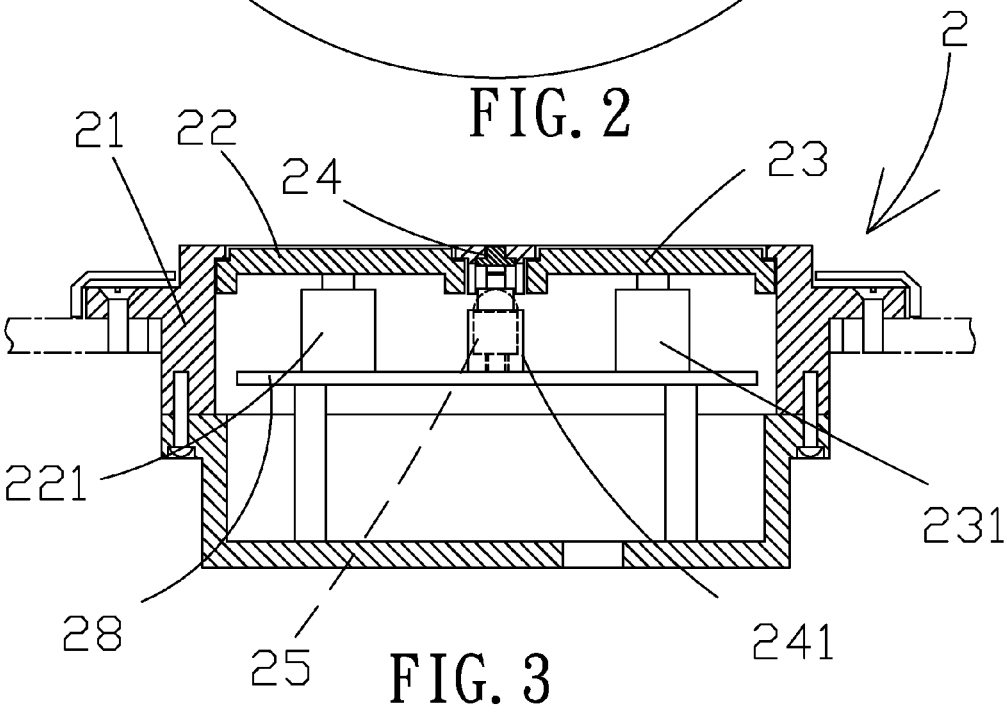
FIG. 3 is a sectional view of the control unit.
Figure 4:
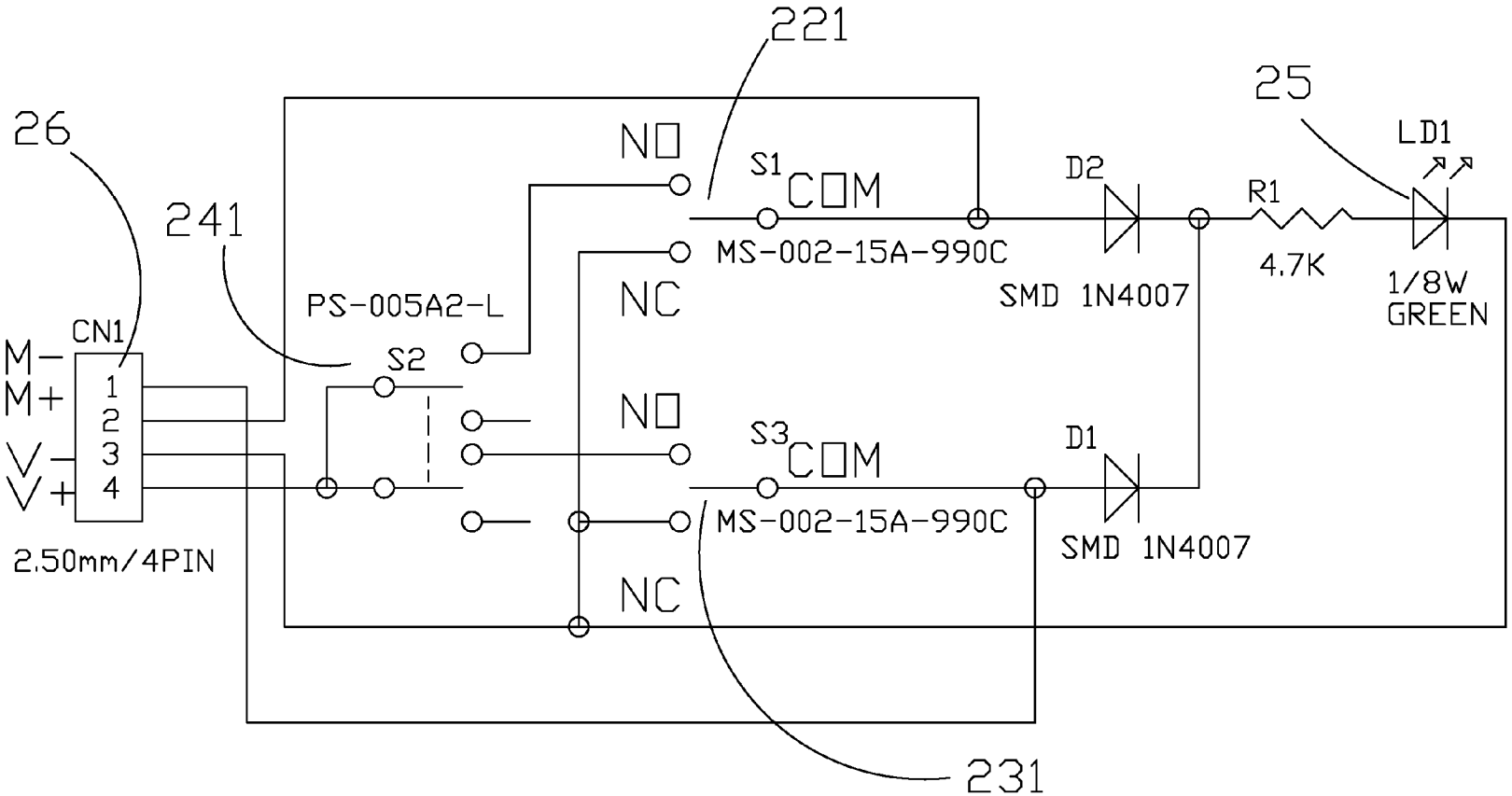
FIG. 4 is a circuit diagram of the control unit.
Figure 5:
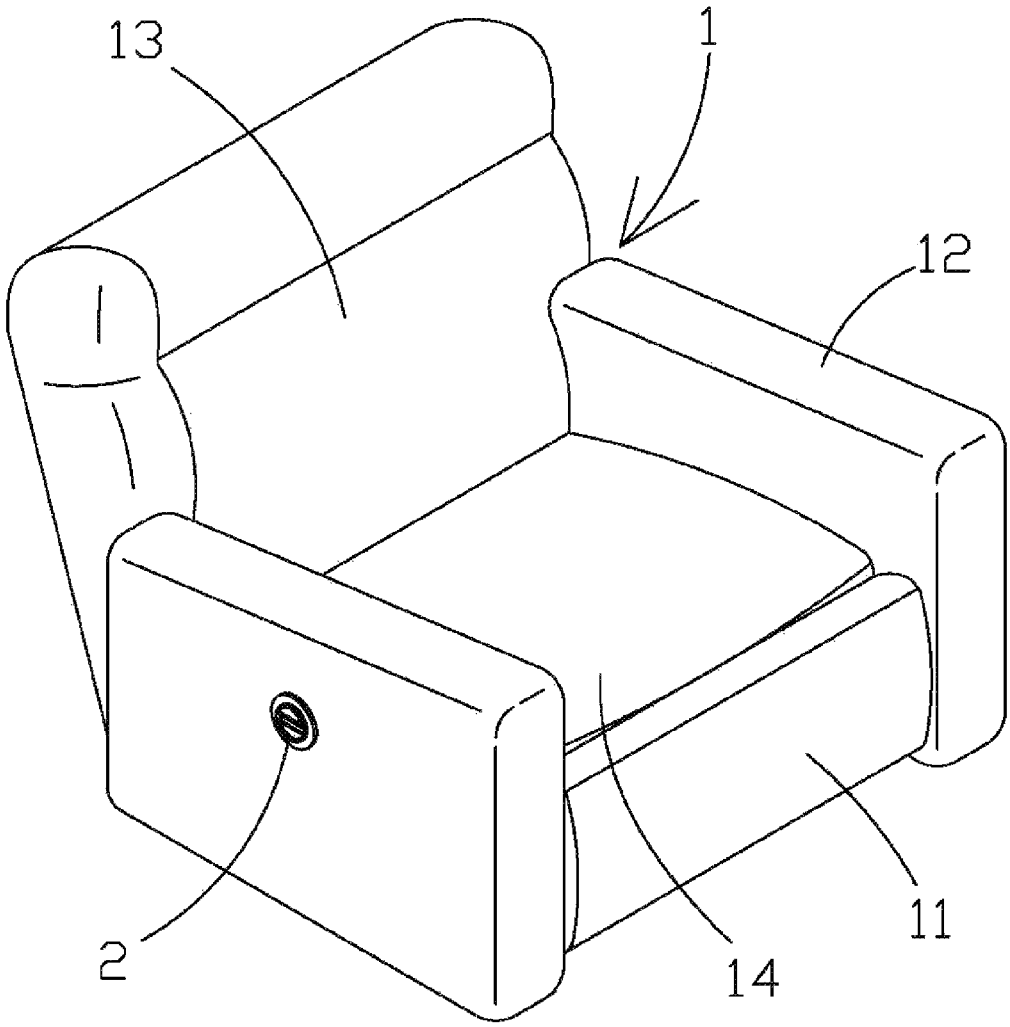
FIG. 5 is a perspective view of a club chair incorporating the mechanism for electrically adjusting chair components of the invention.
Figure 6:
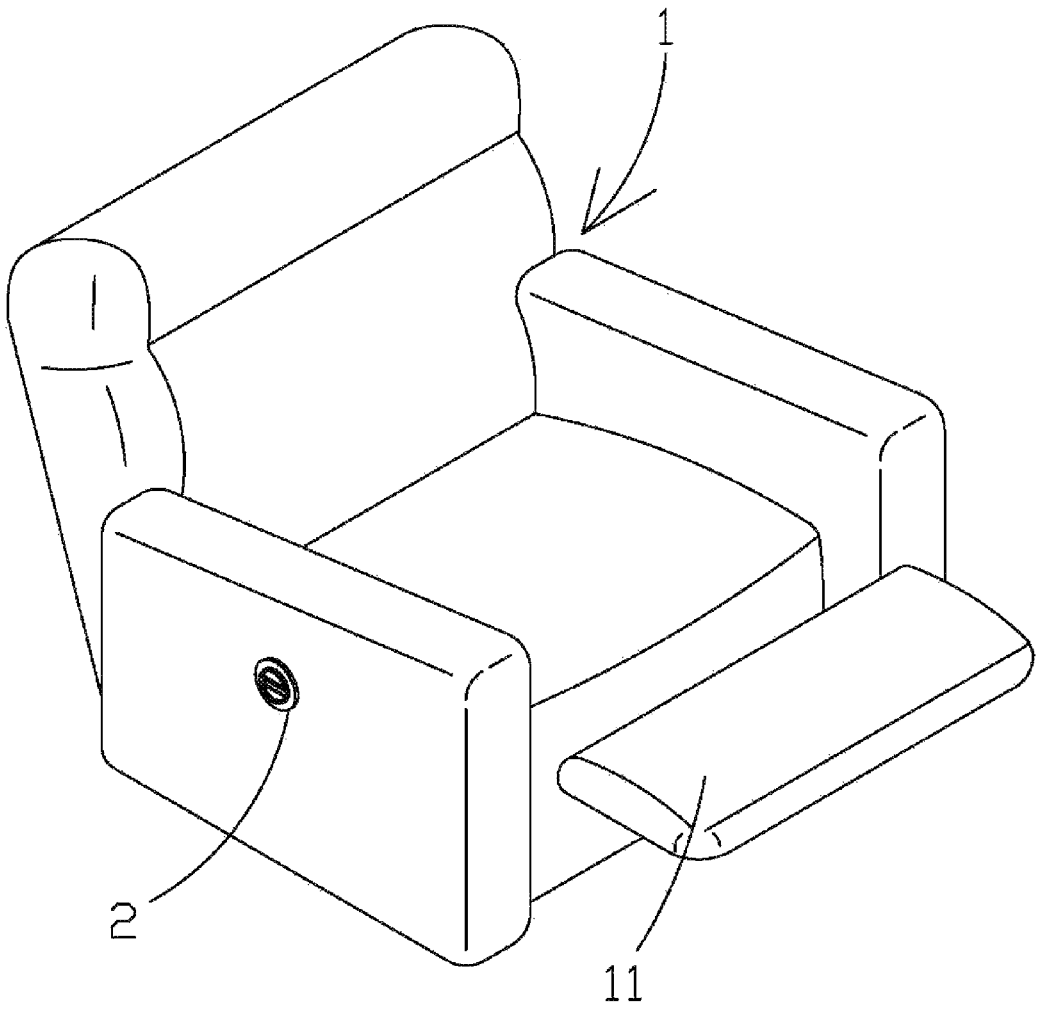
FIG. 6 is a view similar to FIG. 5 with the control unit being extended.
Figure 7:
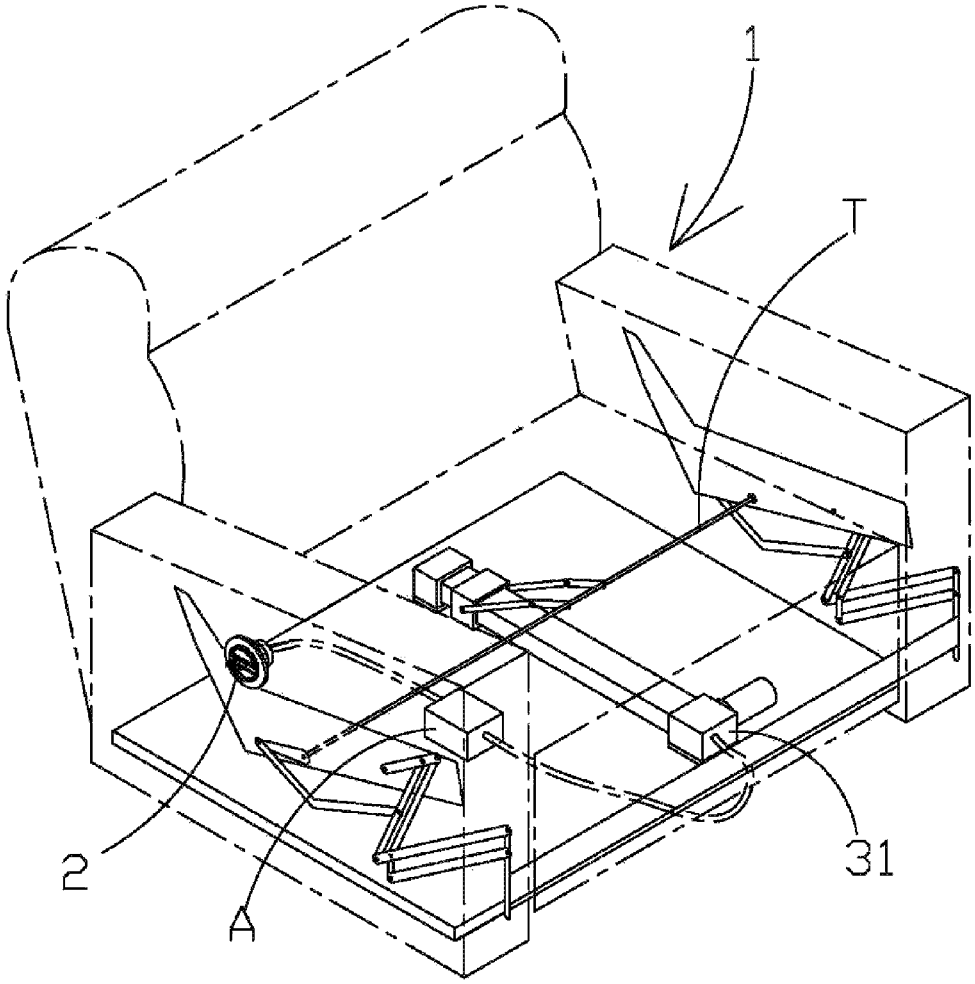
FIG. 7 is a view similar to FIG. 5 showing the mechanism for electrically adjusting chair components of the invention.
Figure 8:
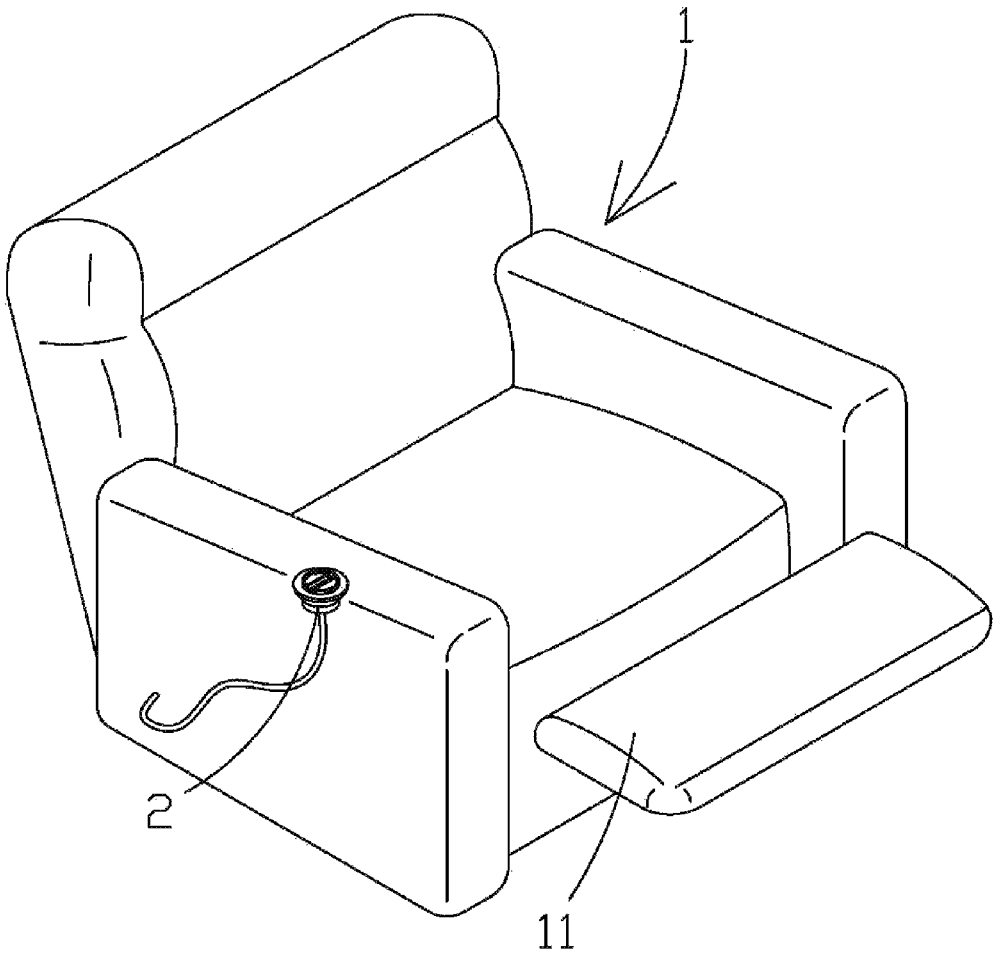
FIG. 8 is a view similar to FIG. 6 showing another configuration of the control unit.

The control unit 2 further comprises a frame 21 fitted on the surface of an arm 12 of the chair 1 (see FIG. 5). Alternatively, a portion of the wire 2 and the control unit 2 are disposed externally of the chair 1 (see FIG. 8).

The control unit 2 further comprises a half-circular extending operation button 22, a half-circular retracting operation button 23, the extending and retracting operation buttons 22, 23 being separated by an elongated central member 20, a hole 29 on the central member 20, an indicator 25 in the hole 29, a printed circuit board (PCB) 28 in the frame 21 electrically connected to the indicator 25, a first contact switch 221 mounted on the PCB 28 and disposed behind the extending operation button 22, a second contact switch 231 mounted on the PCB 28 and disposed behind the retracting operation button 23, and an on/off switch 24 on a center of the central member 20 and electrically connected to a contact 241 around the indicator 25 on the PCB 28.

A reciprocating unit 3 comprises the motor 31 mounted on a base 30, a lead screw 32 having one end rotatably attached to the motor 31, a screw-type slide 33 threadedly put on the lead screw 32 and adapted to move between a limit member 34 mounted on the base 30 at one end of the lead screw 32 and the motor 31, two parallel first link members 35 each having one end attached to one side of the screw-type slide 33, a transverse rod T pivotably passing the other ends of the first link members 35, and two second link members 36 each having one end pivotably connected to either end of the transverse rod T.

Two foot, seat, and back adjustment units 4 are provided at either side of the chair 1. Each foot, seat, and back adjustment unit 4 comprises a bent first link 41 having one end pivotably connected to the other end of the second link member 36, a second link 42 having a central pivot pivotably connected to the other end of the first link 41, a third link 44 having an intermediate pivot pivotably connected to one end of the second link 42 and the other end connected to a seat and backrest frame 37, a bent fourth link 43 having a substantial portion parallel to the second link 42 and having one end pivotably connected to one end of the third link 44, a fifth link 45 having one end pivotably connected to the other end of the second link 42 and a pivot pivotably connected to the bent portion of the fourth link 43, a sixth link 46 parallel to the fifth link 45 having one end pivotably connected to the other end of the fourth link 43, and a seventh link 47 having one end pivotably connected to the other end of the fifth link 45 and a pivot, proximate its one end, pivotably connected to the other end of the sixth link 46. A foot rest 11 is mounted on the seventh links 47.

Figure 9:
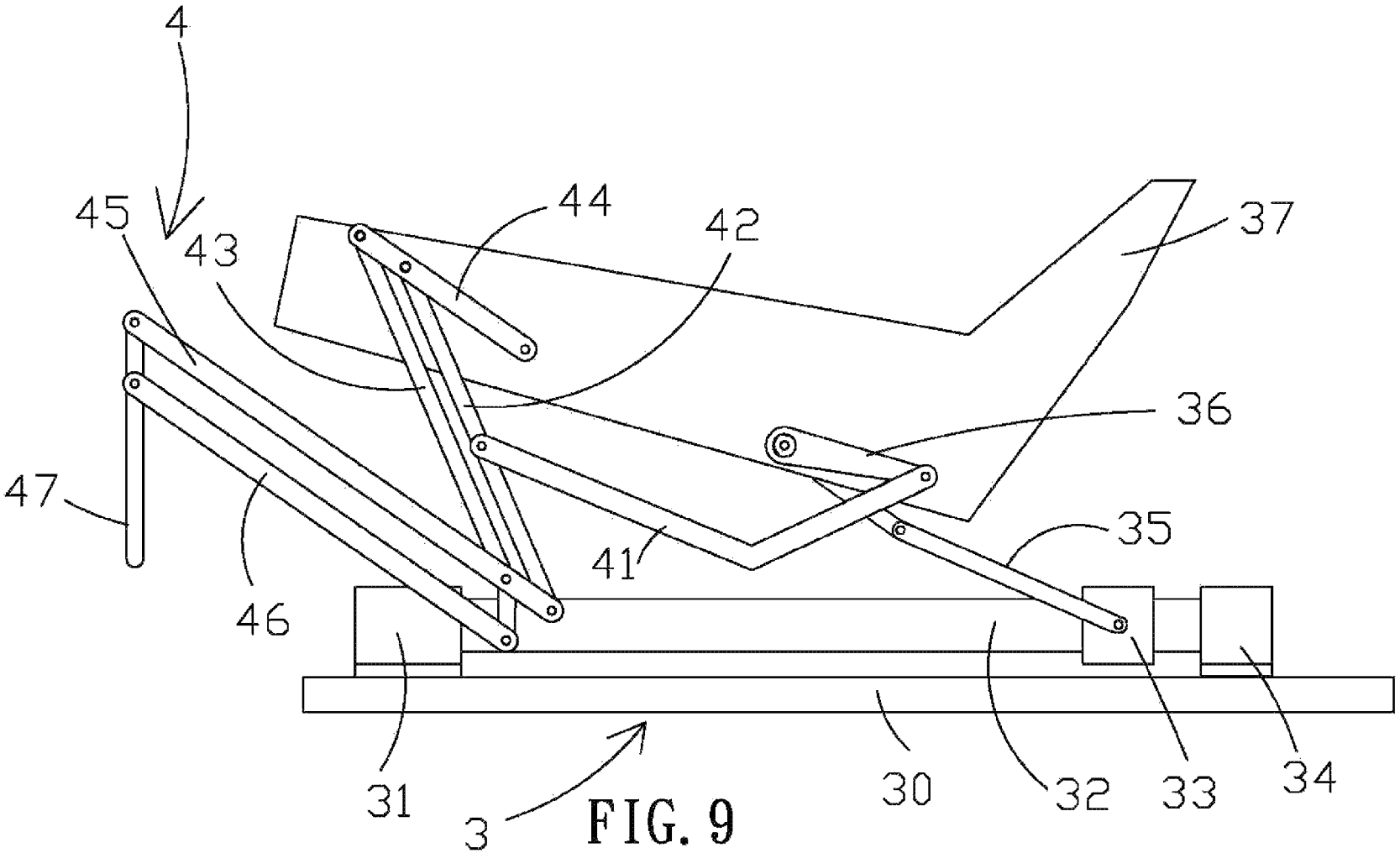
FIG. 9 is a side elevation of a reciprocating unit and a foot, seat, and back adjustment unit of the mechanism shown in FIG. 7.
Figure 10:
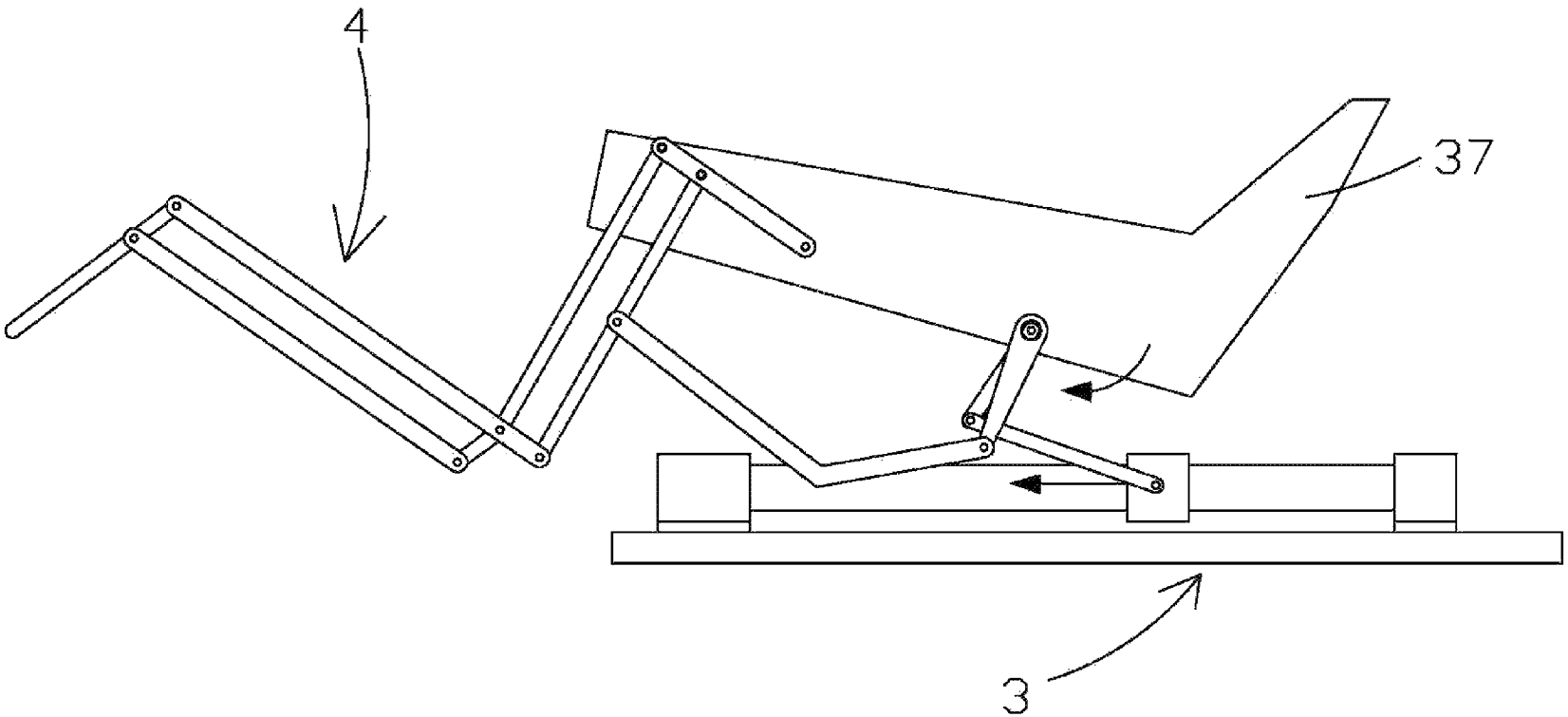
FIGS. 10 and 11 are views similar to FIG. 9 showing an extending operation of the mechanism.
Figure 11:
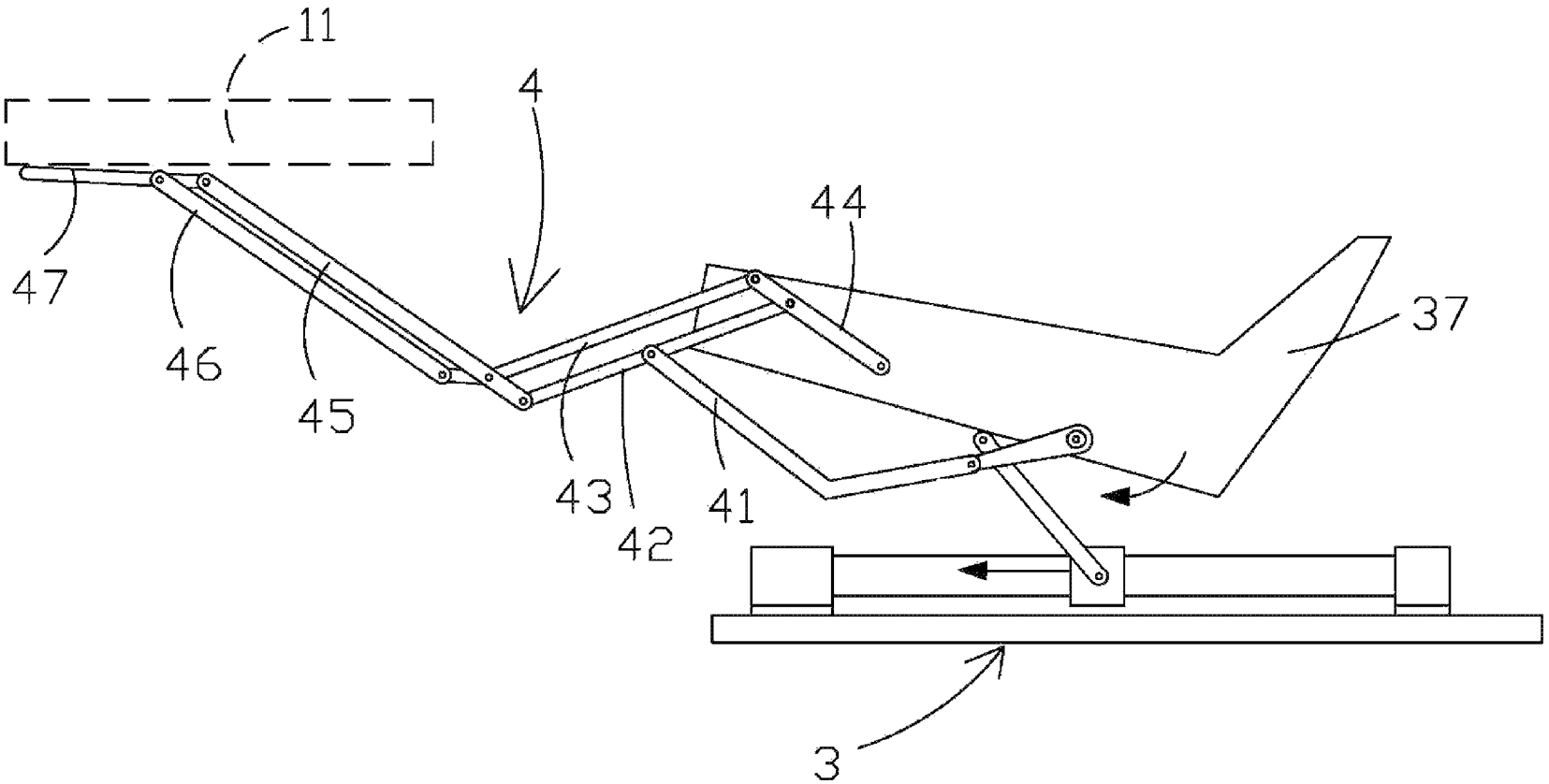

As shown in FIGS. 9, 10, and 11 specifically, in use an individual may first press the on/off switch 24 to turn on the indicator 25 to emit, for example, green light. Next, the individual may press the extending operation button 22 to cause the motor 31 to turn clockwise. Therefore, the mechanism is activated to cause the screw-type slide 33 to move from a position proximate the limit member 34 toward a position proximate the motor 31 along the lead screw 32. Hence, the linking components of the mechanism extend to tilt the seat and backrest frame 37 and extend the seventh link 47. As a result, a seat 14 and a backrest 13 tilt, and the foot rest 11 extends. The individual may stop the components adjustment operation by releasing the extending operation button 22 if a desired comfortable position is reached. Thereafter, the chair components are positioned. It is understood that the individual may press the retracting operation button 23 to counterclockwise turn the motor 31 if he or she wants to retract the chair components to their original positions after use. Thereafter, the screw-type slide 33 moves away from the motor 31 to its predetermined original position proximate the limit member 34. As a result, the chair components return to their original positions.

Figure 12:
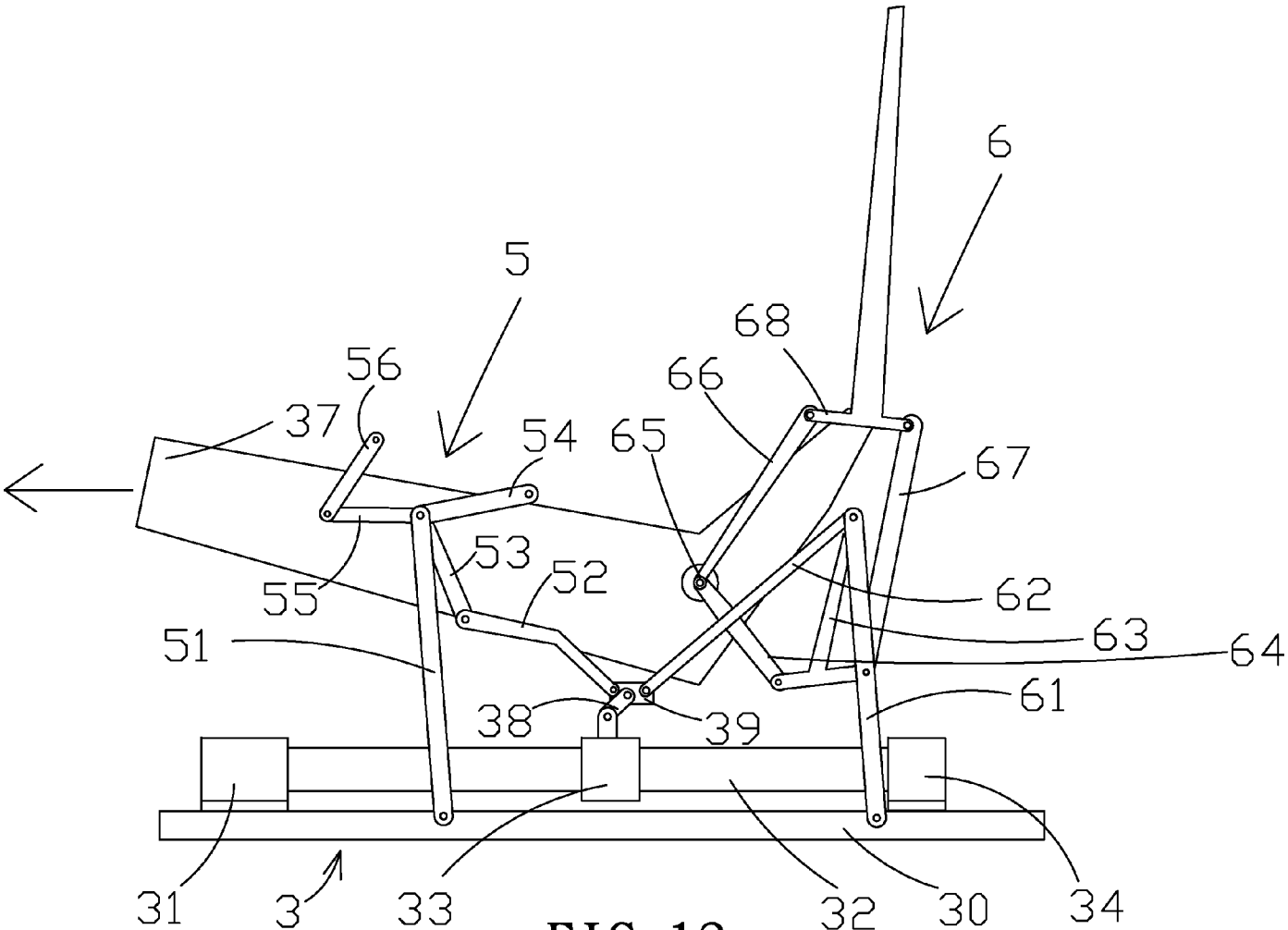
FIG. 12 is a side elevation of a reciprocating unit and a foot, seat, and back adjustment unit of a mechanism a mechanism for electrically adjusting components of a chair according to a second preferred embodiment of the invention.
Figure 13:
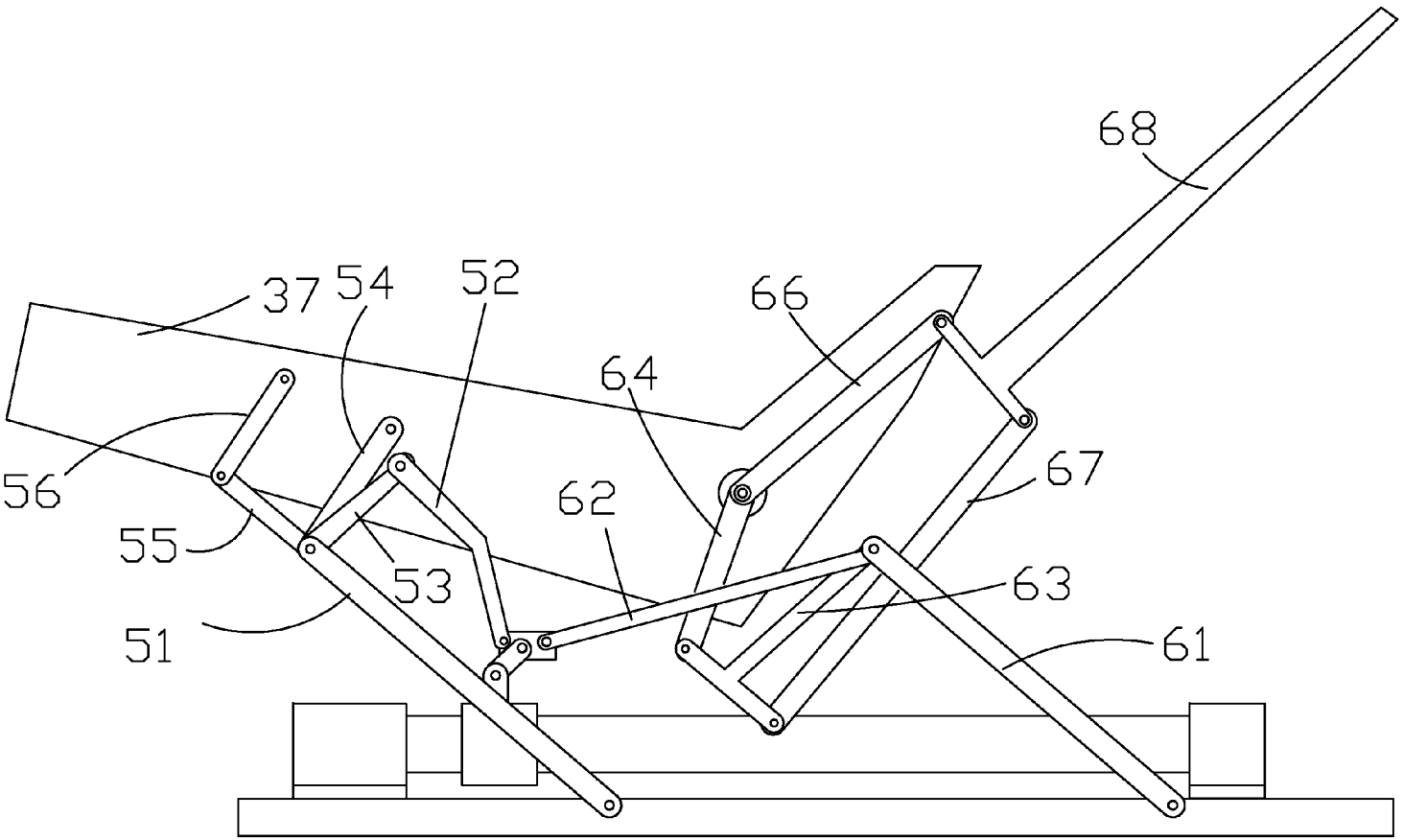
FIG. 13 is a view similar to FIG. 12 showing an extending operation of the mechanism of FIG. 12.

Referring to FIGS. 12 and 13, a mechanism for electrically adjusting components of a chair (e.g., club chair) in accordance with a second preferred embodiment of the invention is shown. The characteristics of the second preferred embodiment are detailed below. At either side of the chair, the following components are provided. A link 38 has one end pivotably connected to the screw-type slide 33 and the other end pivotably connected to a first pivotal joint 39 which is pivotably connected to a seat and foot adjustment unit 5 and a back adjustment unit 6 respectively as detailed below.

The seat and foot adjustment unit 5 comprises a first linking element 51 having one end pivotably connected to the base 30 proximate the motor 31, a bent second linking element 52 having one end pivotably connected to the pivotal joint 39, a third linking element 53 having one pivotably connected to the other end of the second linking element 52 and the other end pivotably connected to the other end of the first linking element 51, a fourth linking element 54 having one end pivotably connected to the other ends of both the first and third linking elements 51, 53 and the other end pivotably connected to the arm (not shown), a fifth linking element 55 having one end pivotably connected to the other ends of both the first and third linking elements 51, 53, and a sixth linking element 56 having one end pivotably connected to the other end of the fifth linking element 55 and the other end pivotably connected to the arm (not shown).

The back adjustment unit 6 comprises a first link element 61 having one end pivotably connected to the base 30 proximate the limit member 34, a second link element 62 having one end pivotably connected to the first pivotal joint 39 and the other end pivotably connected to the other end of the first link element 61, a substantially T-shaped third link element 63 having one end of its longer part pivotably connected to the other end of the first link element 61, a fourth link element 64 having one end pivotably connected to one of the shorter part of the third link element 63, a second pivotal joint 65 mounted to the seat and backrest frame 37 and pivotably connected to the other end of the fourth link element 64, a fifth link element 66 having one end pivotably connected to the second pivotal joint 65, a sixth link element 67 having one end pivotably connected to the other end of the shorter part of the third link element 63, and a T-shaped link element 68 having one end of its shorter part pivotably connected to the other end of the fifth link element 66, the other end of its shorter part pivotably connected to the other end of the sixth link element 67, and its longer part mounted to the chair back (not shown).

Referring to FIGS. 12 and 13 in conjunction with FIGS. 1 to 5, in use an individual may first press the on/off switch 24 to turn on the indicator 25. Next, the individual may press the extending operation button 22 to cause the motor 31 to turn clockwise. Therefore, the mechanism is activated to cause the screw-type slide 33 to move from a position as shown in FIG. 12 toward a position proximate the motor 31 along the lead screw 32. Hence, the linking components of the mechanism extend to tilt the seat and backrest frame 37. As a result, the seat 14 and the backrest 13 tilt. The individual may stop the components adjustment operation by releasing the extending operation button 22 if a desired comfortable position is reached. Thereafter, the chair components are positioned. It is understood that the individual may press the retracting operation button 23 to counterclockwise turn the motor 31 if he or she wants to retract the chair components to their original positions after use. Thereafter, the screw-type slide 33 moves away from the motor 31 to its predetermined original position proximate the limit member 34. As a result, the chair components return to their original positions.

While the invention herein disclosed has been described by means of specific embodiments, numerous modifications and variations could be made thereto by those skilled in the art without departing from the scope and spirit of the invention set forth in the claims.

What is claimed is:

1. A chair comprising:

a seat (14);

two arms (12);

a back (13);

a foot rest (11);

a seat and backrest frame (37) fixedly mounted to the seat (14) and the back (13);

a control unit (2) mounted on either arm (12) and comprising an extending operation button (22), a retracting operation button (23), an indicator (25), an on/off switch (24), and a printed circuit board (PCB) (28) electrically connected to a direct current (DC) power source (A), the on/off switch (24), the indicator (25), the extending operation button (22), and the retracting operation buttons (23);

a reciprocating unit (3) mounted under the seat (14) and comprising a base (30), a DC motor (31) mounted on the base (30) and electrically connected to the DC power source (A), a lead screw (32) having one end rotatably attached to the DC motor (31), a limit member (34) mounted on the base (3) and aligned with the DC motor (31), a screw-type slide (33) threadedly put on the lead screw (32) and adapted to move between the limit member (34) at one end of the lead screw (32) and the DC motor (31) at the other end of the lead screw (32), two parallel first link members (35) each having one end attached to one side of the screw-type slide (33), a transverse rod (T) pivotably passing the other ends of the first link members (35), and two second link members (36) each having one end pivotably connected to either end of the transverse rod (T); and two foot, seat, and back adjustment units (4) disposed in the arms (12) respectively, each of the foot, seat, and back adjustment units (4) comprising a bent first link (41) having one end pivotably connected to the other end of the second link member (36), a second link (42) pivotably connected to the other end of the first link (41), a third link (44) pivotably connected to one end of the second link (42) and the other end connected to the seat and backrest frame (37), a bent fourth link (43) having a substantial portion parallel to the second link (42) and having one end pivotably connected to one end of the third link (44), a fifth link (45) pivotably connected to the bent portion of the fourth link (43) and having one end pivotably connected to the other end of the second link (42), a sixth link (46) parallel to the fifth link (45) and having one end pivotably connected to the other end of the fourth link (43), and a seventh link (47) pivotably connected to the other end of the sixth link (46) and having one end pivotably connected to the other end of the fifth link (45), either end of the foot rest (11) being mounted on the seventh link (47), whereby pressing the on/off switch (24) and pressing the extending operation button (22) will clockwise turn the DC motor (31), move the screw-type slide (33) toward the DC motor (31) along the lead screw (32), extend the components (41, 42, 43, 44, 45, 46, 47) of the foot, seat, and back adjustment units (4) via the pivotal connections of the first link members (35), the transverse rod (T), and the second link members (36), tilt the seat and backrest frame (37) from its predetermined position, and extend the foot rest (11); and whereby pressing the retracting operation button (23) will counterclockwise turn the DC motor (31), move the screw-type slide (33) toward the limit member (34) along the lead screw (32), retract the components (41, 42, 43, 44, 45, 46, 47) of the foot, seat, and back adjustment units (4) via the pivotal connections of the first link members (35), the transverse rod (T), and the second link members (36), retract the foot rest (11), and cause the seat and backrest frame (37) to return to its predetermined position.

* * * * *